United States Patent [19]

Katayama et al.

[11] Patent Number: 4,666,617

[45] Date of Patent: May 19, 1987

[54] COLD ROLLING OIL FOR STEEL SHEET

[75] Inventors: Toshitake Katayama; Hiroshi Kuwamoto; Shuichi Iwado, all of Fukuyama; Sakae Sonoda, Tokyo; Shoji Okamoto, Tokyo; Koji Kaburagi, Tokyo, all of Japan

[73] Assignee: Nippon Kokan Kabushiki Kaisha, Japan

[21] Appl. No.: 770,066

[22] Filed: Aug. 28, 1985

[30] Foreign Application Priority Data

Aug. 31, 1984 [JP] Japan ..... 59-182100

[51] Int. Cl.[4] ..... C10M 129/00

[52] U.S. Cl. ..... 252/32; 252/51.5 R; 252/32.5

[58] Field of Search ..... 252/51.5 R, 32, 32.5

[56] References Cited

U.S. PATENT DOCUMENTS

| | | | |
|---|---|---|---|
| 2,291,214 | 7/1942 | Dietrich | 252/51.5 R |
| 3,657,129 | 4/1972 | Obermeier | 252/51.5 R |
| 3,808,133 | 4/1974 | Brown | 252/56 R |
| 3,840,462 | 10/1974 | Gretschlager | 252/51.5 R |
| 3,879,304 | 4/1975 | Waldbillig | 252/56 R |
| 3,980,571 | 9/1976 | Marx | 252/51.5 R |
| 4,027,512 | 6/1977 | Piucci et al. | 252/51.5 R |
| 4,036,766 | 7/1977 | Yamamoto et al. | 252/51.5 R |
| 4,051,050 | 9/1977 | Elliott et al. | 252/51.5 R |

*Primary Examiner*—William R. Dixon, Jr.
*Assistant Examiner*—Cynthia A. Prezlock
*Attorney, Agent, or Firm*—Ostrolenk, Faber, Gerb & Soffen

[57] ABSTRACT

The present invention provides a cold rolling oil for steel sheets characterized by incorporating various rolling oils with oil-soluble high-molecular compounds which are obtained by salt-forming:

(a) homopolymers of nitrogen-containing monomers or copolymers of two or more of said monomers having the following general formulae (I) and (II):

(I)

(II)

wherein $R_1$ is H or $CH_3$, and $R_2$ as well as $R_3$ are $CH_3$, $C_2H_5$, or $C_3H_7$, respectively, or (b) copolymers selected from at least one nitrogen-containing monomers having said general formulae (I) and (II) and at least one of acrylic or methacrylic acid, or the alkyl esters or alkyl amides thereof.

with a compound selected from fatty acids of 6–9 carbon atoms, diesters of fatty alcohols of 6–9 carbon atoms and phosphoric acid and mixtures thereof.

5 Claims, 1 Drawing Figure

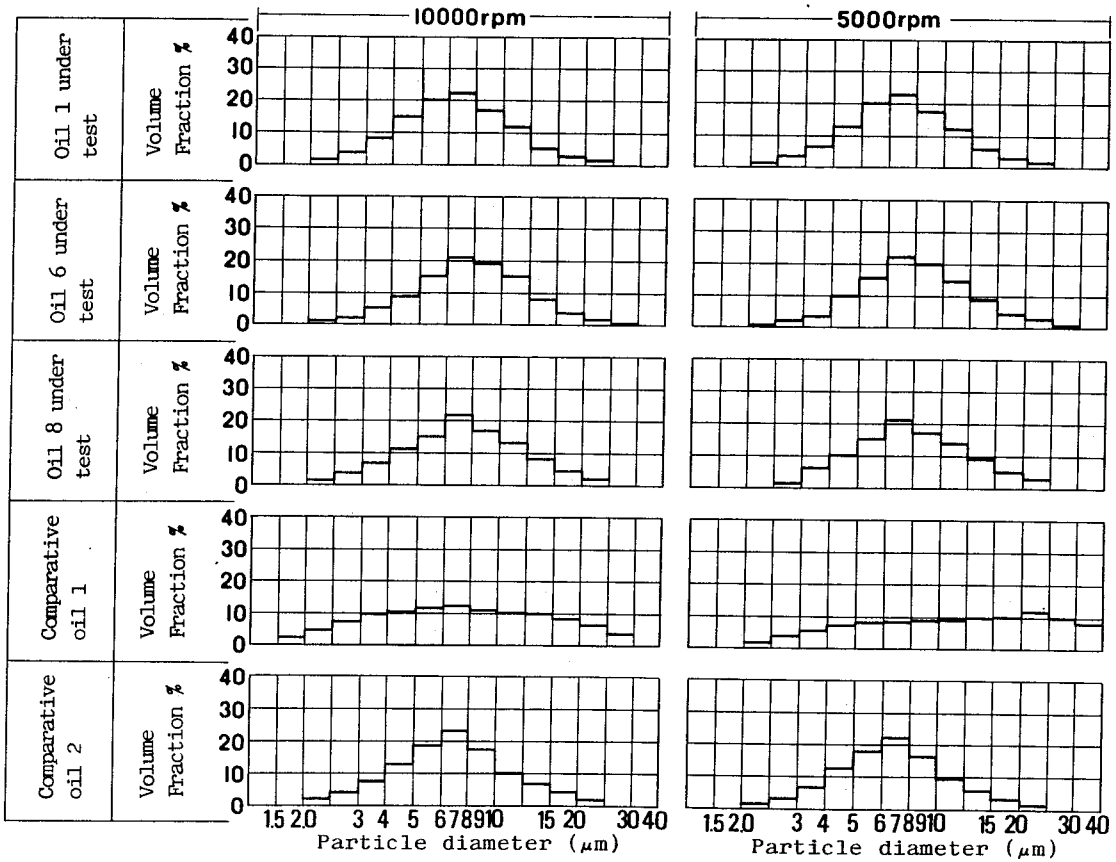
10000rpm
5000rpm
Comparative oil 2
Comparative oil 1
Oil 8 under test
Oil 6 under test
Oil 1 under test
Volume Fraction %
0
10
20
30
40
1.5 2.0 3 4 5 6 7 8 9 10 15 20 30 40
Particle diameter (μm)

COLD ROLLING OIL FOR STEEL SHEETcl

BACKGROUND OF THE INVENTION

1. Field of the Invention

This invention relates to cold rolling oils (hereinafter referred to simply as "rolling oil") for steel sheets which are applied for cold rolling of steel sheets and have excellent lubricity, lubrication stability, emulsion as well as dispersion stability, and fresh oil replenishing property.

2. Description of the Prior Art

Rolling oils are prepared by adding oiliness improvers, extreme-pressure additives, antioxidants, various emulsifying agents and the like to animal or vegetable oils such as tallow, palm oil and the like, various synthetic esters, mineral oils, or the mixed oils thereof. In rolling, a liquid obtained by emulsifying and dispersing a rolling oil in a suitable concentration (hereinafter referred to "coolant liquid") by means of mechanical agitation in a tank (hereinafter referred to "coolant tank") is sprayed on work rolls for cooling and the surface of steel sheets for lubricating, and is circulated.

For the sake of elevating productivity, it is recently intended to perform high-speed rolling and continuous manufacturing of steel sheets. In this respect, it is required that the rolling oil has excellent lubricity, and particularly stability of lubrication.

In case of cold rolling, such rolling oil sprayed between a work roll and the surface of a steel sheet is pulled into the interface between the work roll and the surface of steel sheet by means of hydrodynamic action and the like, and therefore the rolling oil decreases friction and wear. In this case, a greater amount of such rolling oil pulled in results in the better lubricity.

The amount of the above described rolling oil pulled in depends on the amount of plate-out in case of a small amount of plate-out, whilst the amount of the rolling oil pulled in depends upon viscosity of the rolling oil in case of a larger amount of plate-out. In other words, such rolling oil having the greater plate-out amount as well as the higher viscosity exhibits more rolling oil being pulled in. In this case, it is generally acknowledged that the viscosity varies in response to changes in pressure and temperature as it given by the following equation:

$$\eta = \eta_0 \exp(\alpha_p - \beta_T) \quad (1)$$

where $\eta$: viscosity of fluid in pressure P and temperature T, $\eta_0$: standard viscosity, $\alpha$: viscosity.pressure coefficient, $\beta$: viscosity.temperature coefficient.

Namely, the viscosity increases in accordance with pressure increase and decreases in accordance with temperature rise.

When the plate-out amount of rolling oil varies and it is deficient in uniformity, variation of lubrication is caused even if there is a greater amount of plate-out. Furthermore, when the viscosity of rolling oil varies, it results in variation of lubrication. The amount of plate-out is significantly related to particle size the of rolling oil in a coolant liquid to be sprayed (amount of plate-out becomes small in case of small particle size), so that lubricity is dependent upon particle size of the rolling oil. Such particle size is easily influenced by stirring conditions. In this connection, since a coolant liquid passes thorugh pumps, nozzles and return lines by means of circulation in addition to agitation of the coolant liquid in coolant tanks in case of rolling, the stirring conditions vary. Even under such conditions as mentioned above, it is desired that particle size of the rolling oil is uniform and stable. Furthermore the viscosity of a rolling oil is affected by the surface temperature of work rolls and steel sheets. Since temperatures vary in case of rolling, such a rolling oil exhibiting less viscosity change with respect to temperature change is desired.

Nonionic or anionic emulsifying and dispersing agents have heretofore been employed for rolling oils. On one hand, rolling oil particles exhibit a particle size distribution of wide range extending from 2 to 40 $\mu$m, because of formation of finer particles due to agitation and formation of larger particles due to coagulation. Owing to such non-uniformity, the plate-out amount becomes also non-uniform so that lubricity varies easily.

As a result of various studies, the above described problem can be solved by using a water-soluble cationic high-molecular compound and/or a water-soluble amphoteric high-molecular compound as emulsifying and dispersing agent. Water-soluble cationic high-molecular compounds and water-soluble amphoteric high-molecular compounds have been utilized for organic substances such as oils as coagulant and dispersion stabilizer. It is known that a slight amount of these water-soluble high-molecular compounds exhibits a coagulating effect in acidic aqueous solutions, whilst a strong dispersion stabilizing effect is observed in the case when a comparatively large amount of such water-soluble high-molecular compounds is employed. This is because an organic substance is negatively charged by means of agitation so that the organic substance charged is strongly electrically adsorbed on a water-soluble high-molecular compound. Further, in the case where a slight amount of water-soluble high-molecular compound is used, the surface potential of organic substance particles (hereinafter referred to "particles")are neutralized so that such water-soluble high-molecular compound exhibits a coagulating effect. On the other hand, when a large amount of such water-soluble high-molecular compound is utilized, the high-molecular compound covers the particles to give a positive surface potential hereto so that coagulation is prevented by the resulting electric repulsion effect as well as steric hindrance effect of the macromolecule, and it exhibits dispersion stability.

When such a water-soluble high-molecular compound is used for rolling oil as the emulsifying and dispersing agent, since the high-molecular compound has excellent coagulation resistance, particles formed in case of vigorous agitation are not coagulated and exist stably even if the agitation force becomes weaker. Furthermore, since the emulsifying and dipersing agent is a high-molecular compound, such compound covers a plurality of fine particles so that comparatively large particles exist. As a result, the particle size distribution is narrow and sharp.

However, a water-soluble high-molecular compound reduces scarcely reduces interfacial tension, although such compound is excellent in emulsion and dispersion stability, and such water-soluble high-molecular compound is inferior in initial emulsifying and dispersing property so that higher energy for agitation than that in conventional cases is required for emulsification and dispersion. Thus, such water-soluble high-molecular compound does not emulsify and disperse rolling oil easily at the time of replenishing the rolling oil so that the target concentration is not obtained. As a result, more rolling oil than is required is replenished, and the cost of rolling oil becomes high arises. In addition, the trouble that lubricity varies arises, because such oil which has not been initially emulsified and dispersed floats on the liquid and is involved nonuniformly in the circulating system. Furthermore, since these water-soluble high-molecular compounds do not dissolve in rolling oil, either such high-molecular compound is forcibly dispersed into the rolling oil, or such high-molecular compound and rolling oil are separately replenished to the coolant tank should be undertaken in case of employing said water-soluble high-molecular compounds. In this respect, there are problems of workability as well as rolling oil control compared with one-peak type rolling oils.

OBJECT OF THE INVENTION

It is an object of the present invention to provide cold rolling oils for steel sheets which can comply with speeding-up of rolling as well as continuation of steel sheet production and by which problems of lubricity, lubrication stability, emulsion as well as dispersion stability, and oil replenishing have been solved in the form of one-pack type rolling oils.

BRIEF DESCRIPTION OF THE DRAWINGS

FIG. 1 is a graphical representation indicating each particle size distribution in respect of typical oils under test as well as comparative oils.

DETAILED DESCRIPTION OF THE INVENTION

The present invention made by attaining the aforesaid object provides a cold rolling oil for steel sheets characterized by incorporating various rolling oils. with oil-soluble high-molecular compounds which are obtained by salt-forming:

(a) homopolymers of nitrogen-containing monomers or copolymers of two or more of said monomers having the following general formulae (I) and (II):

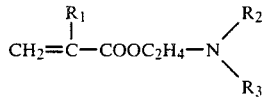

(I)

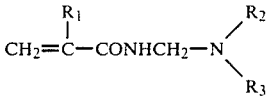

(II)

wherein $R_1$ is H or $CH_3$, and $R_2$ as well as $R_3$ are $CH_3$, $C_2H_5$, or $C_3H_7$, respectively, or (b) copolymers prepared from at least one nitrogen-containing monomers having said general formulae (I) and (II) and at least one of acrylic or methacrylic acid, or the alkyl esters or alkyl amides thereof, with a compound selected from fatty acids of 6–9 carbon atoms, diesters of fatty alcohols of 6–9 carbon atoms and phosphoric acid and mixtures thereof.

An example of the nitrogen-containing monomers having the general formula (I) described in (a) includes N, N-dimethylaminoacrylate, N, N-dimethylaminoethylmethacrylate, N,N-diethylaminoethylmethacrylate, N, N-dipropylaminoethylmethacrylate or the like. An example of the nitrogen-containing monomers having the general formula (II) includes N, N-diethylaminomethylmethacrylamide, N, N-dipropylaminomethylmethacrylateamide or the like. In these homopolymers or copolymers prepared from said monomers, those having an average molecular weight ranging from 8,000 to 1,000,000 are utilized.

Examples of the alkyl esters of vinyl monomer to be copolymerized with said nitrogen-containing monomers described in (b) include methyl acrylate, methyl methacrylate, lauryl methacrylate or the like, whilst an example of the alkyl amides includes acrylamide, methacrylamide or the like. In thses copolymers, those having an average molecular weight ranging from 8,000 to 1,000,000 may be used.

An example of the fatty acids for salt-forming as the pair ion includes caproic acid, heptanoic acid, caprylic acid, and pelargonic acid, whilst an example of the diesters of phosphoric acid includes dihexylphosphate, diheptylphosphate, dioctylphosphate or the like.

When the rolling oil containing said oil-soluble high-molecular compound according to the present invention is dispersed into water, shows it displays a cationic property so that it exhibits the same effects as those in the aforesaid water-soluble cationic high-molecular compounds and it makes emulsion and dispersion stability of the rolling oil favorable. Furthermore, since such oil-soluble high-molecular compound has an effects of for increasing viscosity and viscosity index of rolling oils, it improves lubricity and lubrication stability of these rolling oils as described above. However, the advantageous effects are not so remarkable upon emulsion and dispersion stability when the average molecular weight of said oil-soluble high-molecular compound is less than 8,000, whilst there is the disadvantage that handling thereof becomes inconvenient in case of an average molecular weight of more than 1,000,000, so that it is not practical.

The high-molecular compounds according to the present invention are influenced by the carbon atoms of an fatty acid as a pair ion applied for salt-forming as well as of an fatty alcohol in the phosphoric acid esters, so that functions of the high-molecular compounds change. Interfacial tension in the case where one of the high-molecular compounds according to the present invention is salt-formed with an equivalent weight of each fatty acid, and solubility as well as initial emulsifying and dispersing property in the case where 5 parts of each of these salts are incorporated in 95 parts of No. 1 spindle oil will be shown in Table 1.

TABLE 1

| Carbon Atoms of (Fatty) Acid | Interfacial Tension (dyne/cm) | Solubility to No. 1 Spindle Oil | Initial Emulsifying and Dispersing Property |
|---|---|---|---|
| 2 | 63.7 | insoluble | poor |
| 3 | 54.8 | insoluble | poor |
| 4 | 50.3 | insoluble | poor |
| 5 | 49.5 | slightly soluble | poor |
| 6 | 46.4 | soluble | good |
| 8 | 34.4 | soluble | good |
| 9 | 32.4 | soluble | good |
| 10 | 32.3 | soluble | poor |
| 12 | 32.8 | soluble | poor |

(Note)
The oil-soluble high-molecular compound used: Homopolymer of $N,N_4$—diethylaminoethylmethacrylate (average molecular weight: $10 \times 10^4$).

The oil-soluble high-molecular compound obtained through salt-forming with fatty acid lowers interfacial tension so that it exhibits initial emulsifying property. In this case, however, the oil-soluble high-molecular compound is weak in decreasing the interfacial tension where the fatty acid for salt-forming has less than 6 carbon atoms so that sufficient initial emulsifying and dispersing property cannot be obtained, and also there is the disadvantage that such high-molecular compound salt hardly dissolves in rolling oils. On the other hand, when the fatty acid has more than 9 carbon atoms, the salt becomes poor in its hydrophilic nature so that it does not exhibits initial emulsifying and dispersing property.

EXAMPLE

Initial emulsifying and dispersing property was observed on the basis of visual evaluation by means of deemulsifying tester (agitation: 1500 rpm) with use of each oil under test (10% concentration, 60° C. temperature) mentioned hereinbelow. Furthermore emulsion and dispersion stability was observed by measuring of particle size distribution and average particle size in respect of rolling oil particles after stirring the oil under test having 3% concentration and 60° C. temperature at 10,000 rpm for 30 min. by means of homomixer as well as particle size distribution and average particle size of the rolling oil particles after further stirring the oil under test at much lower 5,000 rpm for another 30 min. by utilizing a coulter counter. Results as to the initial emulsifying and dispersing property as well as the average particle size are shown in Table 2, respectively, and the particle size distribution in the above measurement is shown in FIG. 1.

The coefficient of friction and torque varying value were determined by rolling steel sheets with use of each oil under test (3% concentration, 60° C. temperature) under the conditions as described hereinafter and the results thereof will be shown in Table 2. In this case, the coefficient of friction suggests lubricity so that the lower coefficient of friction exhibits the better lubricity. On one hand, the torque varying value suggests lubrication stability, and the lower torque varying value exhibits the better lubrication stability. It is to be noted that such torque varying value corresponds to a difference between the maximum and minimum values in respect of the torque values determined in rolling.

Furthermore the same measurement was effected upon each compartive oil, and the results thereof are also shown in Table 2 and FIG. 1, respectively.

| | |
|---|---|
| <Oil 1 under Test> | |
| Tallow | 94 parts |
| Homopolymer of N,N—diethylaminoethylmethacrylate (average molecular weight: $10 \times 10^4$) | 5 parts |
| Caprylic acid | 1 parts |
| <Oil 2 under Test> | |
| Tallow | 93 parts |
| Homopolymer of N,N—diethylaminoethylmethacrylate (average molecular weight: $10 \times 10^4$) | 5 parts |
| Dioctyl phosphate | 2 parts |
| <Oil 3 under Test> | |
| Tallow | 94 parts |
| Copolymer (6:4) of N,N—dimethylaminoethylmethacrylate and N,N—diethylaminomethylmethacrylamide (average molecular weight: $10 \times 10^4$) | 5 parts |
| Caprylic acid | 1 part |
| <Oil 4 under Test> | |
| Tallow | 94 parts |
| Homopolymer of N,N—diethylaminomethylacrylamide (average molecular weight: $10 \times 10^4$) | 5 parts |
| Caprylic acid | 1 part |
| <Oil 5 under Test> | |
| Tallow | 94 parts |
| Copolymer (8:2) of N,N—diethylaminomethylacrylamide and acrylic acid (average molecular weight: $10 \times 10^4$) | 5 parts |
| Caprylic acid | 1 part |
| <Oil 6 under Test> | |
| Tallow | 93 parts |
| Copolymer (8:2) of N,N—diethylaminoethylmethacrylate and methacrylic acid (average molecular weight: $10 \times 10^4$) | 5 parts |
| Dioctyl phosphate | 2 parts |
| <Oil 7 under Test> | |
| Tallow | 93 parts |
| Copolymer (3:1) of N,N—diethylaminoethylacrylate and methylacrylate (average molecular weight: $10 \times 10^4$) | 5 parts |
| Dioctylphosphate | 2 parts |
| <Oil 8 under Test> | |
| Tallow | 94 parts |
| Copolymer (3:1) of N,N—diethylaminomethylmethacrylamide and methylmethacrylate (average molecular weight: $10 \times 10^4$) | 5 parts |
| Caprylic acid | 1 parts |
| <Oil 9 under Test> | |
| Tallow | 94 parts |
| Copolymer (3:1) of diethylaminoethylacrylate and acrylamide (average molecular weight: $10 \times 10^4$) | 5 parts |
| Caprylic acid | 1 part |
| <Oil 10 under Test> | |
| Tallow | 93 parts |
| Copolymer (3:1) of N,N—diethylaminomethylmethacrylamide and methacrylamide (average molecular weight: $10 \times 10$) | 5 parts |
| Dioctyl phosphate | 2 parts |
| <Comparative Oil 1> | |
| Tallow | 95 parts |
| Polyoxyethylene sorbitan monooleate (EO: 20 mol) | 5 parts |
| <Comparative Oil 2> | |
| Tallow | 95 parts |
| Homopolymer of N,N—dimethylaminoethylmethacrylate quarternary ammonium salt (average molecular weight: $10 \times 10^4$) | 5 parts |

Rolling Condition

Material to be rolled: SPCC, $1.2^t$ mm × $50^\omega$mm × $100^l$ m
Work roll diameter: 150ϕmm
Work roll surface: Bright ($R_{max}$=0.8 μm)
Rolling speed: 20 m/min
Rolling reduction: 40%
Tension: 15 kg/mm$^2$ in both forward and backward tension
Manner of lubrication: Spray coating on upper and lower roll (flow rate, 6 l/min)

| Item | Oil 1 under Test | Oil 2 under Test | Oil 3 under Test | Oil 4 under Test | Oil 5 under Test | Oil 6 under Test | Oil 7 under Test | Oil 8 under Test | Oil 9 under Test | Oil 10 under Test | Comparative Oil 1 | Comparative Oil 2 |
|---|---|---|---|---|---|---|---|---|---|---|---|---|
| Form of Rolling Oil | one-pack Type | one-pack Type | one-pack Type | one-pack Type | one-pack Type | one-pack Type | one-pack Type | one-pack Type | one-pack Type | one-pack Type | one-pack Type | Two-pack Type |
| Initial Emulsifying and Dispersing Property | Good | Good | Good | Good | Good | Good | Good | Good | Good | Good | Good | Poor |
| Average Particle Diameter (μm) 10000 rpm | 7.1 | 7.1 | 7.1 | 71. | 7.8 | 7.7 | 7.3 | 7.3 | 7.3 | 7.3 | 7.4 | 6.8 |
| Average Particle Diameter (μm) 5000 rpm | 7.0 | 7.0 | 7.1 | 7.2 | 7.9 | 7.8 | 7.4 | 7.5 | 7.3 | 7.3 | 12.0 | 6.7 |
| Viscosity (60° C., cst) | 38.7 | 38.3 | 36.5 | 34.8 | 31.9 | 32.5 | 35.3 | 35.1 | 34.2 | 32.3 | 21.8 | 22.2 |
| Viscosity Index | 207 | 207 | 201 | 195 | 193 | 205 | 202 | 203 | 200 | 195 | 175 | 180 |
| Coefficient of Friction | 0.061 | 0.061 | 0.061 | 0.062 | 0.062 | 0.061 | 0.061 | 0.062 | 0.062 | 0.062 | 0.079 | 0.073 |
| Torque Varying Value (kg · m) | 1.1 | 1.1 | 1.1 | 1.2 | 1.2 | 1.1 | 1.1 | 1.2 | 1.2 | 1.1 | 3.3 | 21. |

As is apparent from the above Table 2, oils 1–10 under test are excellent in initial emulsifying and dispersing property as well as emulsion and dispersion stability (scarce changes being observed in average particle sizes of 10,000 rpm and 5,000 rpm), the viscosity as well as viscosity index thereof are high, whilst coefficient of friction and torque varying value are low. Comparative oil 1 is excellent in initial emulsifying and dispersing property, but poor in emulsion and dispersion stability, and the torque varying value thereof is high. Comparative oil 2 is excellent in emulsion and dispersion stability and the torque varying value thereof is also comparatively low, but poor in initial emulsifying and dispersing property. Furthermore all the oils 1–10 under test exhibit lower coefficient of friction as compared with those of comparative oils 1 and 2. As to the form of rolling oils, oils 1–10 under test are one-pack type unlike comparative oil 2 of two-pack type (non-oil soluble), so that they are also excellent in view of workability as well as control for rolling oils.

While the example wherein tallow is used as the base oil has been described above, the invention is not limited thereto and, of course, such modification wherein various rolling oils involving single oils such as natural fats and oils, synthetic esters, and mineral oils or mixed oils, or those containing oiliness improvers, extreme-pressure additives, antioxidants, surfactants and the like may be included in the present invention.

As described above, the cold rolling oils for steel sheets according to the present invention can be prepared by incorporating a rolling oil with an oil-soluble high-molecular compound obtained by salt-forming of a homopolymer of nitrogen-containing monomer selected from formula (I) and (II) or copolymer of nitrogen-containing monomer selected from formula (I) and (II) and at least one of acrylic or methacrylic acid, or the alkyl esters or alkyl amides thereof with a compound selected from fatty acids having 6–9 carbon atoms, diesters of fatty alcohols having 6–9 carbon atoms and phosphoric acid and mixture thereof. In the cold rolling oils of the invention thus prepared, rolling oil particles have suitable dimensions, and since said high-molecular compound is oil-soluble, viscosity and viscosity index of the rolling oils increases so that they are excellent in initial emulsifying and dispersing property. As a result, the cold rolling oils according to the present invention exhibit excellent lubricity and lubrication stability, whereby the excellent advantage that high-speed cold rolling as well as continuous manufacturing of steel sheets become possible, and hence the productivity thereof can be elevated can be obtained.

While a rolling oil must be that of two-pack type in conventional rolling oils in order to obtain the emulsion and dispersion stability, the rolling oils of the present invention are one-pack type so that workability and control for such rolling oils can significantly be improved.

What is claimed is:

1. A cold rolling oil for steel sheets comprising a rolling oil and an effective emulsifying and dispersing amount of oil-soluble high-molecular salt of:

(a) (1) homopolymers of nitrogen-containing monomers or copolymers of two or more of said monomers having the following general formulae (I) and (II):

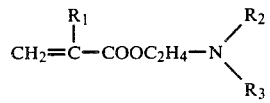

(I)

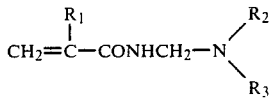

(II)

wherein $R_1$ is H or $CH_3$, and $R_2$ as well as $R_3$ are $CH_3$, $C_2H_5$, OR $C_3H_7$, respectively, or (2) copolymers prepared from at least one nitrogen-containing monomers having said general formulae (I) and (II) and at least one of acrylic or methacrylic acid, or the alkyl esters or alkyl amides thereof, and (b) a compound selected from the group consisting of fatty acids of 6–9 carbon atoms, diesters of fatty alchols of 6–9 carbon atoms with phosphoric acid and mixtures thereof.

2. A cold rolling oil for steel sheets as claimed in claim 1 wherein the average molecular weight of said homopolymers or copolymers is within a range of 8,000–1,000,000.

3. A cold rolling oil for steel sheets as claimed in claim 2 wherein said nitrogen containing monomer is selected from the group consisting of N,N-dimethylaminoacrylate, N,N-dimethylaminothylmethacrylate, N,N-diethylaminoethylmethacrylate, N,N-dipropylaminoethylmethacrylate, N,N-diethylaminomethylmethacrylamide and N,N-dipropylaminomethylmethacrylamide, wherein said alkyl ester is selected from the group consisting of methyl acrylate, methyl methacrylate and lauryl methylacrylate, and wherein said alkyl amide is selected from the group consisting of acrylamide and methacrylamide.

4. A cold rolling oil for steel sheets as claimed in claim 3 wherein said compound (b) is selected from the group consisting of caproic acid, heptanoic acid, caprylic acid, pelargonic acid, dihexylphosphate, diheptylphosphate and dioctylphosphate.

5. A cold rolling oil for steel sheets as claimed in claim 4 wherein said compound (b) is caprylic acid or dioctylphosphate and wherein said polymer (a) is selected from the group consisting of homopolymer of N,N-diethylaminoethylmethacrylate, copolymer of N,N-dimethylaminoethylmethacrylate and N,N-diethlaminomethylmethacrylamide, homopolymer of N,N-diethylaminomethylacrylamide, copolymer of N,N-diethylaminomethylamide and acrylic acid, copolymer of N,N-diethylaminoethylmethacrylate and methacrylic acid, copolymer of N,N-diethylaminoethylacrylate and methyl acrylate, copolymer of N,N-diethylaminomethylmethacrylamide and methylmethacrylate, copolymer of diethylaminoethylacrylate and acrylamide and copolymer of N,N-diethylaminomethylmethacrylamide and methacrylamide.

* * * * *

UNITED STATES PATENT AND TRADEMARK OFFICE

CERTIFICATE OF CORRECTION

PATENT NO. : 4,666,617

DATED : May 19, 1987

INVENTOR(S) : Toshitake Katayama et al.

It is certified that error appears in the above-identified patent and that said Letters Patent is hereby corrected as shown below:

In the headings under "[73] Assignee:" read --Nippon Kokan Kabushiki Kaisha, Japan and Nihon Parkerizing Co. Ltd., Japan--.

In the Abstract, line 4 from the end, for "." read --,--.

Column 1, line 2, for "SHEETcl" read --SHEET--; line 62, for "the of" read --of the--; line 68, for "thorugh" read --through--.

Column 2, line 7, after "Since" read --such--; line 8, delete "such"; line 45, for "hereto" read --thereto--; line 61, delete "reduces" (first instance).

Column 3, line 4, delete "arises"; line 5, for "such" read --the--; line 37, delete ".".

Column 4, line 21, delete "shows"; line 26, for "effects" read --effect--; line 27, delete "for"; line 63, for "N.$N_4$-die-" read -- N,N-die- --.

Column 5, line 10, for "exhibits" read --exhibit--; line 53, 58, 65 and 67, in the 4 instances, for "N.N" read --N,N--.

Column 6, line 2, for "10 / $10^4$" read --10 x $10^4$--; line 23, for "Dioctyl phosphate" read --Dioctylphosphate--; line 46, for "10 x 10" read --10 x $10^4$--; line 47, for "Dioctyl phosphate" read --Dioctylphosphate--; line 53, for "N.N" read --N,N--.

Signed and Sealed this

Second Day of February, 1988

*Attest:*

DONALD J. QUIGG

*Attesting Officer*

*Commissioner of Patents and Trademarks*